US008167656B2

(12) United States Patent
Reeves et al.

(10) Patent No.: US 8,167,656 B2
(45) Date of Patent: May 1, 2012

(54) CONNECTING HARDWARE WITH MULTI-STAGE INDUCTIVE AND CAPACITIVE CROSSTALK COMPENSATION

(75) Inventors: Stuart James Reeves, Cheltenham (GB); David Patrick Murray, Bristol (GB); Ian Robert George, Churchdown (GB); Bernard Harold Hammond, Jr., Aurora, CO (US)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/975,009

(22) Filed: Dec. 21, 2010

(65) Prior Publication Data

US 2012/0003874 A1 Jan. 5, 2012

Related U.S. Application Data

(63) Continuation of application No. 12/472,166, filed on May 26, 2009, now Pat. No. 7,854,632, which is a continuation of application No. 11/974,175, filed on Oct. 11, 2007, now Pat. No. 7,537,484.

(60) Provisional application No. 60/851,831, filed on Oct. 13, 2006.

(51) Int. Cl.
*H01R 24/00* (2006.01)

(52) U.S. Cl. ..... 439/620.11; 439/676; 439/941

(58) Field of Classification Search ..... 439/620.11–620.23, 676, 941
See application file for complete search history.

(56) References Cited

U.S. PATENT DOCUMENTS 5,864,089 A 1/1999 Rainal
5,915,989 A 6/1999 Adriaenssens et al.
5,940,959 A 8/1999 Caveney et al.
5,989,071 A 11/1999 Larsen et al.
5,997,358 A 12/1999 Adriaenssens et al.
6,089,923 A 7/2000 Phommachanh
6,107,578 A 8/2000 Hashim
6,120,330 A 9/2000 Gwiazdowski
6,139,371 A 10/2000 Troutman et al.
6,165,018 A 12/2000 Arnett et al.
6,168,474 B1 1/2001 German et al.
6,186,834 B1 2/2001 Arnett et al.
6,196,880 B1 3/2001 Goodrich et al.
6,231,397 B1 5/2001 de la Borbolla et al.
6,238,231 B1 5/2001 Chapman et al.
6,270,381 B1 8/2001 Adriaenssens et al.
6,350,158 B1 2/2002 Arnett et al.
6,371,793 B1 4/2002 Doorhy et al.
6,379,157 B1 4/2002 Curry et al.
6,428,362 B1 8/2002 Phommachanh (Continued)

FOREIGN PATENT DOCUMENTS

EP 0 898 340 A1 2/1999

(Continued)

*Primary Examiner* — Gary F. Paumen
(74) *Attorney, Agent, or Firm* — Merchant & Gould P.C.

(57) ABSTRACT

A connector and method of crosstalk compensation within a connector is disclosed. The method includes determining an uncompensated crosstalk, including an uncompensated capacitive crosstalk and an uncompensated inductive crosstalk, of a wired pair in a connector. The uncompensated crosstalk includes common mode and differential mode crosstalk. The method includes applying at least one inductive element to the wired pair, where the at least one inductive element is configured and arranged to provide balanced compensation for the inductive crosstalk caused by the one or more pairs. The method further includes applying at least one capacitive element to the wired pair, where the at least one capacitive element is configured and arranged to provide balanced compensation for the capacitive crosstalk caused by the one or more wired pairs.

21 Claims, 7 Drawing Sheets

U.S. PATENT DOCUMENTS

| | | | | |
|---|---|---|---|---|
| 6,441,318 | B1 | 8/2002 | Kiersh et al. | |
| 6,443,777 | B1 | 9/2002 | McCurdy et al. | |
| 6,464,541 | B1 | 10/2002 | Hashim et al. | |
| 6,530,810 | B2 | 3/2003 | Goodrich et al. | |
| 6,533,618 | B1 | 3/2003 | Aekins | |
| 6,547,604 | B2 | 4/2003 | Arnett et al. | |
| RE38,519 | E | 5/2004 | Doorhy et al. | |
| 6,736,681 | B2 | 5/2004 | Arnett | |
| 6,799,989 | B2 | 10/2004 | Doorhy et al. | |
| 6,830,488 | B2 | 12/2004 | Bush et al. | |
| 6,840,816 | B2 | 1/2005 | Aekins | |
| 6,866,548 | B2 | 3/2005 | Hashim | |
| 6,923,673 | B2 | 8/2005 | Doorhy et al. | |
| 7,186,149 | B2 | 3/2007 | Hashim | |
| 7,265,300 | B2 | 9/2007 | Adriaenssens et al. | |
| 7,381,098 | B2 | 6/2008 | Hammond, Jr. et al. | |
| 7,402,085 | B2 | 7/2008 | Hammond, Jr. et al. | |
| 7,537,484 | B2 | 5/2009 | Reeves et al. | |
| 7,682,203 | B1 | 3/2010 | Pharney et al. | |
| 7,874,879 | B2 * | 1/2011 | Caveney et al. | 439/676 |
| 2001/0021608 | A1 | 9/2001 | de la Borbolla et al. | |
| 2002/0160662 | A1 | 10/2002 | Arnett et al. | |
| 2003/0119372 | A1 | 6/2003 | Aekins | |
| 2003/0157842 | A1 | 8/2003 | Arnett et al. | |
| 2003/0190845 | A1 | 10/2003 | Vaden et al. | |
| 2004/0067693 | A1 | 4/2004 | Arnett | |
| 2004/0077222 | A1 | 4/2004 | AbuGhazaleh et al. | |
| 2004/0082227 | A1 | 4/2004 | Hashim | |
| 2004/0184247 | A1 | 9/2004 | Adriaenssens et al. | |
| 2005/0106946 | A1 | 5/2005 | Doorhy et al. | |
| 2005/0181676 | A1 | 8/2005 | Caveney et al. | |
| 2005/0202697 | A1 | 9/2005 | Caveney et al. | |
| 2005/0250372 | A1 | 11/2005 | Doorhy et al. | |
| 2005/0253662 | A1 | 11/2005 | Seefried | |
| 2005/0254223 | A1 | 11/2005 | Hashim et al. | |
| 2005/0277339 | A1 | 12/2005 | Caveney et al. | |
| 2006/0014410 | A1 | 1/2006 | Caveney | |
| 2006/0154531 | A1 | 7/2006 | Kim et al. | |
| 2007/0117469 | A1 * | 5/2007 | Caveney et al. | 439/676 |
| 2007/0190863 | A1 | 8/2007 | Caveney et al. | |
| 2007/0238366 | A1 | 10/2007 | Hammond, Jr. et al. | |
| 2010/0003847 | A1 | 1/2010 | Hetzer et al. | |
| 2010/0003862 | A1 | 1/2010 | Hetzer et al. | |
| 2010/0041278 | A1 | 2/2010 | Bopp et al. | |

FOREIGN PATENT DOCUMENTS

| | | | |
|---|---|---|---|
| EP | 0 901 201 | A1 | 3/1999 |
| EP | 1 414 115 | A1 | 4/2004 |
| GB | 2 271 678 | A | 4/1994 |
| GB | 2 314 466 | A | 12/1997 |
| WO | WO 02/17442 | A2 | 2/2002 |

* cited by examiner

CONNECTING HARDWARE WITH MULTI-STAGE INDUCTIVE AND CAPACITIVE CROSSTALK COMPENSATION

CROSS-REFERENCE TO RELATED APPLICATIONS

This application is a continuation of application Ser. No. 12/472,166, filed May 26, 2009, which is a continuation of application Ser. No. 11/974,175, filed Oct. 11, 2007, now U.S. Pat. No. 7,537,484, which application claims the benefit of provisional application Ser. No. 60/851,831, filed Oct. 13, 2006, which applications are incorporated herein by reference in their entirety.

TECHNICAL FIELD

The present invention relates generally to telecommunications equipment. More particularly, the present invention relates to connecting hardware configured to compensate for near end and far end crosstalk.

BACKGROUND

In the field of data communications, communications networks typically utilize techniques designed to maintain or improve the integrity of signals being transmitted via the network ("transmission signals"). To protect signal integrity, the communications networks should, at a minimum, satisfy compliance standards that are established by standards committees, such as the International Organization for Standardization (ISO), International Electrotechnical Commission (IEC), or the Telecommunication Industry Association (TIA). The compliance standards help network designers provide communications networks that achieve at least minimum levels of signal integrity as well as some standard of compatibility.

One prevalent type of communication system uses twisted pairs of wires or other conduits to transmit signals. In twisted pair systems, information such as video, audio, and data are transmitted in the form of balanced signals over a pair of conduits, such as wires. The transmitted signal is defined by the voltage difference between the conduits.

Crosstalk can negatively affect signal integrity in twisted pair systems. Crosstalk is unbalanced noise caused by capacitive and/or inductive coupling between conduits of a twisted pair system. Crosstalk can include differential mode and common mode crosstalk, referring to noise created by either differential mode or common mode signals radiating from a transmission conduit. The effects of crosstalk become more difficult to address with increased signal frequency ranges.

Twisting pairs of wires together, such as in twisted pair systems, provides a canceling effect of the differential mode crosstalk created by each individual wire, as the effect of crosstalk created by one wire is compensated for by the corresponding voltage of the complementary wire.

Communications networks include connectors that bring untwisted transmission signals in close proximity to one another. For example, the contacts of traditional connectors (e.g. jacks and plugs) used to provide interconnections in twisted pair telecommunications systems are particularly susceptible to crosstalk interference. This is due in part to the fact that twisted pair wires are typically straight within at least a portion of the connector. Over this untwisted length, a complementary wire no longer provides compensation for wire-to-wire crosstalk. These effects of crosstalk increase when transmission signals are positioned close to one another. Consequently, communications networks connection areas are especially susceptible to crosstalk because of the proximity of the transmission signals.

Crosstalk can be described as a transmission line effect of a "disturbing wire" affecting a "disturbed wire". In the case of cabling-to-cabling effects, the effects can be considered to be a "disturbing channel" on a "disturbed channel". Crosstalk at a given point on a transmission line can be measured according to a number of components based on its source. Near end crosstalk (NEXT) refers to crosstalk that is propagated in the disturbed channel in the direction opposite to the direction of propagation of a signal in the disturbing channel, and is a result of the vector difference between the currents generated by inductive and capacitive coupling effects between transmission lines. Far end crosstalk (FEXT) refers to crosstalk that is propagated in a disturbed channel in the same direction as the propagation of a signal in the disturbing channel, and is a result of the vector sum of the currents generated by inductive and capacitive coupling effects between transmission lines.

An additional form of crosstalk, alien crosstalk, refers to crosstalk that occurs between different cabling (i.e. different channels) in a bundle or otherwise in close proximity, rather than between individual wires or circuits within a single cable. Alien crosstalk can include both alien near end crosstalk (ANEXT) and alien far end crosstalk (AFEXT). Alien crosstalk can be introduced, for example, at a multiple connector interface. This component of crosstalk typically has not presented a performance issue due to the data transmission speeds and encoding involved in existing systems.

Further, common mode signals can affect crosstalk between wires or wire pairs in a single cable or between cables in cabling. These common mode signals can have a detrimental effect upon performance because they can result in differential crosstalk at connectors within a network, adding to the crosstalk noise produced. At current network data transmission speeds, common mode signals have not produced a sufficiently detrimental effect for their consideration to be mandated in current standards.

In twisted pair systems various data transmission protocols exist, each having specific timing and interference requirements. For example, category 3 cabling uses frequencies of up to 10 MHz, and is used in 10 BASE-T networks. Category 5 cabling, which is commonly used in 100 BASE-TX networks operating at 100 Mbit/sec, operates at a frequency of up to 100 MHz. Category 5e cabling can be used in 1000 BASE-T networks, and also operates at up to 100 MHz. Category 6 cabling, because of additional throughput needed, is specified to operate at 250 MHz. Category 6a cabling is currently specified to operate at frequencies of up to 500 MHz.

Many connectors use capacitive elements to compensate for the crosstalk between pairs in a plug and jack connector. Capacitive coupling can be used to achieve a compensative effect on either overall NEXT or FEXT, while having a detrimental effect on the other due to the additive/differential vector effect of each. With increasing data transmission speeds, additional crosstalk of various types is generated among cables, and must be accounted for in designing systems in which compensation for the crosstalk is applied.

SUMMARY

According to one aspect, a method of crosstalk compensation within a connector is disclosed. The method includes determining an uncompensated crosstalk, including an uncompensated capacitive crosstalk and an uncompensated inductive crosstalk, of a wire pair in a connector. The uncompensated crosstalk includes both differential mode and common mode crosstalk. According to the method, the connector has a housing defining a port for receiving a plug, the housing including a plurality of contact springs adapted to make electrical contact with the plug when the plug is inserted into the port of the housing. The contact springs connect to one or more wire pairs. The method also includes applying at least one inductive element to the wire pair, where the at least one inductive element is configured and arranged to provide balanced compensation for the inductive crosstalk caused by the one or more pairs. The method further includes applying at least one capacitive element to the wire pair, where the at least one capacitive element is configured and arranged to provide balanced compensation for the capacitive crosstalk caused by the one or more wire pairs.

According to a second aspect, a connector having balanced crosstalk compensation is disclosed. The connector includes a housing defining a port for receiving a plug. The housing includes a plurality of contact springs adapted to make electrical contact with the plug when the plug is inserted into the port of the housing. The contact springs connect to one or more wire pairs within the housing. The connector also includes at least one inductive element applied to a wire pair. The at least one inductive element is configured and arranged to provide balanced compensation for inductive crosstalk caused by the one or more pairs. The connector also includes at least one capacitive element applied to a wire pair. The at least one capacitive element is configured and arranged to provide balanced compensation for capacitive crosstalk caused by the one or more pairs. The capacitive crosstalk and inductive crosstalk include both differential and common mode crosstalk,

DETAILED DESCRIPTION

The present disclosure relates generally to crosstalk compensation techniques in connecting hardware of telecommunications networks. In connecting hardware such as a plug and jack configuration, inductive and capacitive coupling between transmission lines create near end and far end crosstalk. Where multiple plug and jack configurations are located near each other, additional crosstalk, termed "alien" crosstalk, can affect data transmission. Alien crosstalk can have common mode (as explained below) and differential mode components, and can include both NEXT and FEXT.

Uncompensated signals or unbalanced crosstalk compensation can result in reflected and transmitted common mode signals, TCL and TCTL respectively, on the transmission line carrying data. Current standards set acceptable TCL and TCTL levels arbitrarily, and can be insufficient in some circumstances in that the TCL and TCTL can adversely affect crosstalk at other connectors in the telecommunications network. Specifically, TCL and TCTL can create additional NEXT/FEXT and ANEXT/AFEXT at a different connector or connectors. By applying both balancing inductive and capacitive elements, particularly in a multi-stage arrangement, crosstalk effects can be minimized over a wide range of operating frequencies, and in a manner that balances the crosstalk signals traveling in both directions from the interfering location in various channels.

In general, by effectively balancing the forward and reverse crosstalk signals during crosstalk compensation using inductive and capacitive elements, good bi-directional performance on a single pair is achieved. By applying analogous crosstalk compensation to adjacent pairs, alien crosstalk effects can be minimized as well.

Figure 1:
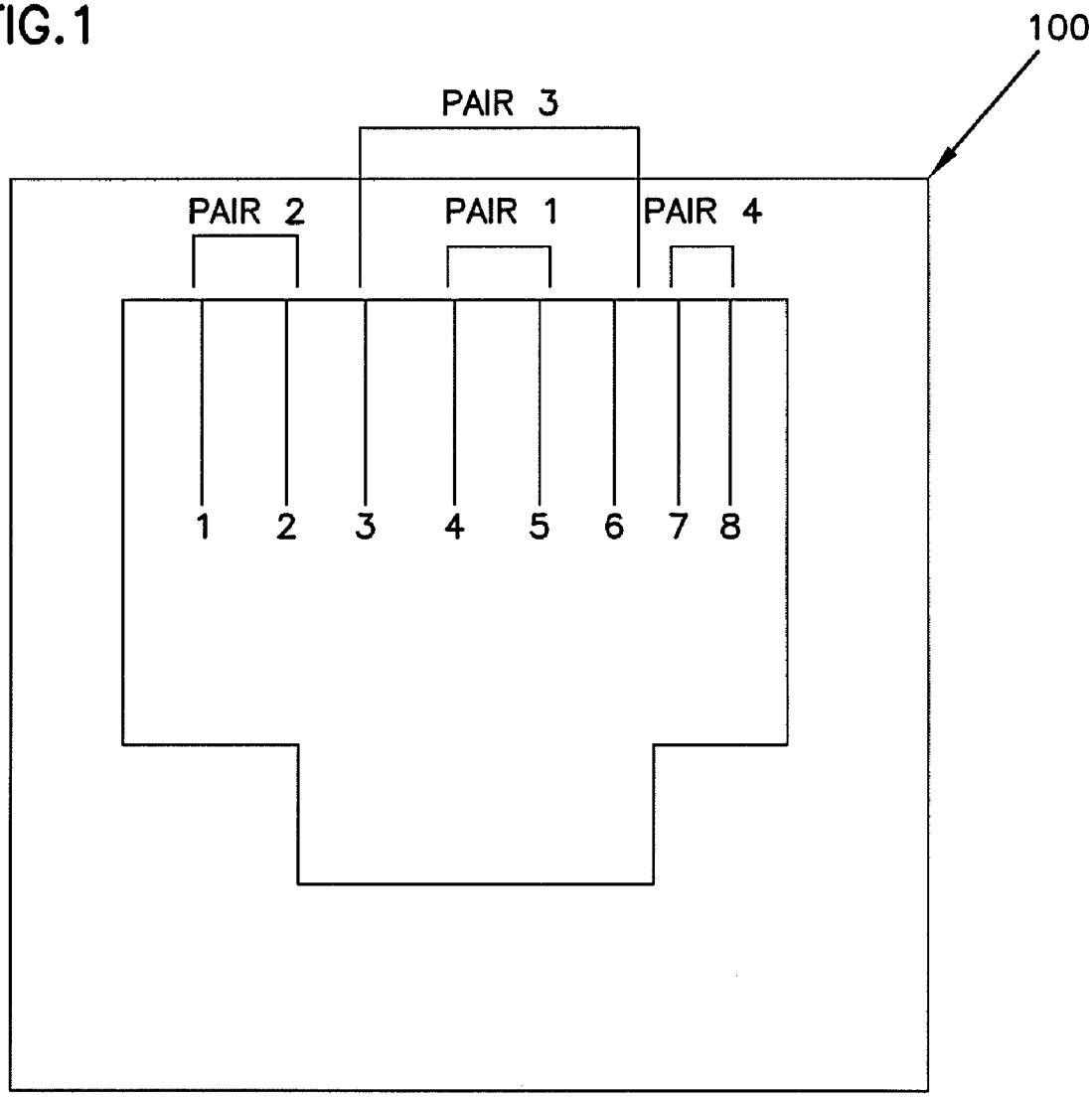
FIG. 1 is a schematic illustration of a jack that can be used in a communications network of the present disclosure.

Referring to FIG. 1, a schematic illustration of a telecommunications jack 100 is shown that can be used in a communications network of the present disclosure. The jack 100 includes eight contact springs, each having a position 1-8. The contact springs are adapted to interconnect with eight corresponding contacts of a plug as shown in FIG. 2.

In use, contact springs 4 and 5 are connected to a first pair of wires, contact springs 1 and 2 are connected to a second pair of wires, contact springs 3 and 6 are connected to a third pair of wires, and contact springs 7 and 8 are connected to a fourth pair of wires. Each pair of wires can constitute a twisted pair within a wire channel leading from the jack 100.

Figure 2:
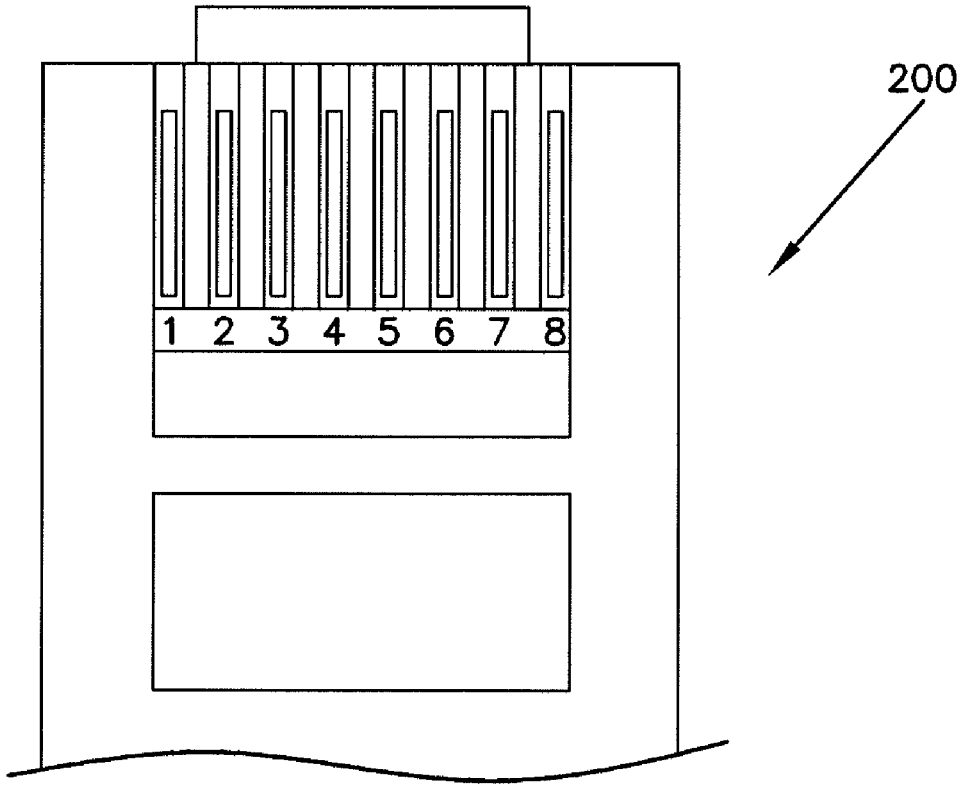
FIG. 2 is a schematic illustration of a plug that can be used in a communications network of the present disclosure.

Referring to FIG. 2, a schematic illustration of a telecommunications plug is shown that can be used in a communications network of the present disclosure. The plug shown has eight contacts corresponding to the contacts of jack 100 of FIG. 1. The plug can be, for example, an RJ-45 type plug to be inserted into the jack, such that the eight contacts electrically connect to the contact springs of the jack.

Figure 4:
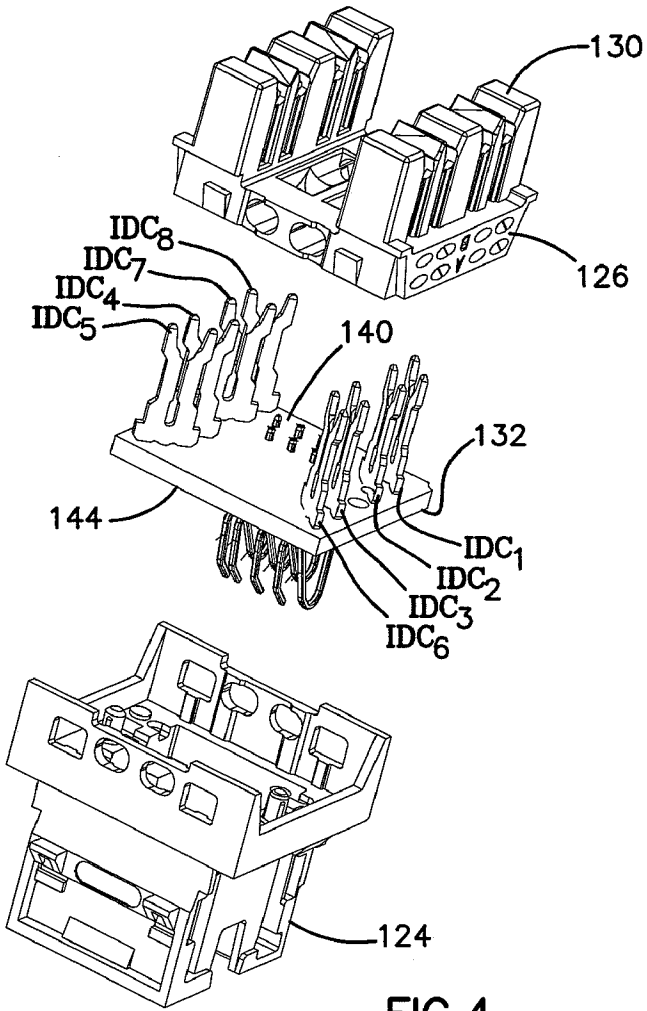
FIG. 4 is an exploded view of the telecommunications jack of FIG. 3.
Figure 3:
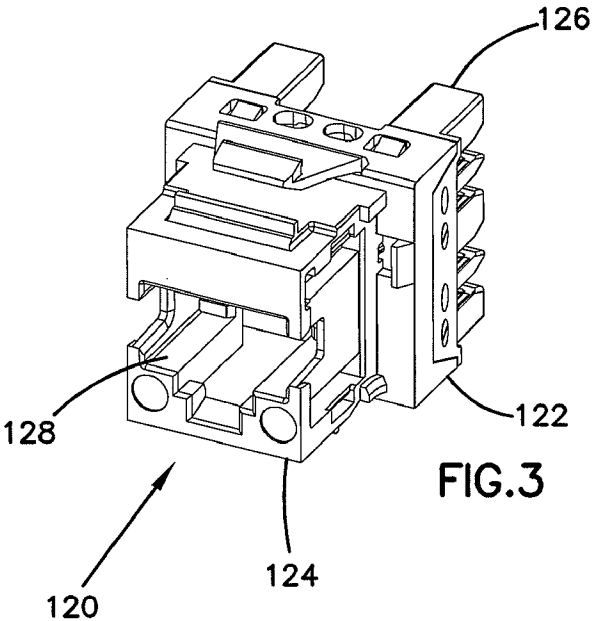
FIG. 3 is a front perspective view of a telecommunications jack having features that are used in conjunction with aspects of the present disclosure.

Referring to FIGS. 3 and 4, a telecommunications jack 120 (i.e., a telecommunications connector) is shown having features that are examples of inventive aspects in accordance with the principles of the present disclosure. The jack 120 includes a dielectric housing 122 having a front piece 124 and a rear piece 126. The front and rear pieces 124, 126 can be interconnected by a snap fit connection. The front piece 124 defines a front port 128 sized and shaped to receive a conventional telecommunications plug (e.g., an RJ style plug such as an RJ 45 plug). The rear piece 126 defines an insulation displacement connector interface and includes a plurality of towers 130 adapted to house insulation displacement connector blades/contacts. The jack 120 further includes a circuit board 132 that mounts between the front and rear pieces 124, 126 of the housing 122. A plurality of contact springs $CS_1$-$CS_8$ are terminated to a front side of the circuit board 132. A plurality of insulation displacement connector blades $IDC_1$-$IDC_8$ are terminated to a back side of the circuit board 132. The contact springs $CS_1$-$CS_8$ extend into the front port 128 and are adapted to be electrically connected to corresponding contacts provided on a plug when the plug is inserted into the front port 128. The insulation displacement connector blades $IDC_1$-$IDC_8$ fit within the towers 130 of the rear piece 126 of the housing 122. The circuit board 132 has tracks $T_1$-$T_8$ that respectively electrically connect the contact springs $CS_1$-$CS_8$ to the insulation displacement connector blades $IDC_1$-$IDC_8$.

In use, wires are electrically connected to the contact springs $CS_1$-$CS_8$by inserting the wires between pairs of the insulation displacement connector blades $IDC_1$-$IDC_8$. When the wires are inserted between pairs of the insulation displacement connector blades $IDC_1$-$IDC_8$, the blades cut through the insulation of the wires and make electrical contact with the center conductors of the wires. In this way, the insulation displacement connector blades $IDC_1$-$IDC_8$, which are electrically connected to the contact springs $CS_1$-$CS_8$ by the tracks on the circuit board, provide an efficient means for electrically connecting a twisted pair of wires to the contact springs $CS_1$-$CS_8$ of the jack 120.

In use, the jack 120 is used in conjunction with a plug 200 as described in FIG. 2. The plug lacks crosstalk compensation, so compensation elements are included in the plug-jack combination via inclusion in the telecommunications jack 120. The crosstalk compensation elements are generally located near the contact springs $CS_1$-$CS_8$, generally within the housing. In one possible embodiment, the crosstalk compensation elements can be located on the circuit board 132.

Multiple plug-jack combinations can be used in closed proximity to each other. A bundle of telecommunications cables can be routed to a patch panel or other network interconnection structure, potentially causing additional crosstalk between the connectors, or channels. Hence, alien crosstalk is likely in configurations using a jack 120 as shown.

Figure 5:
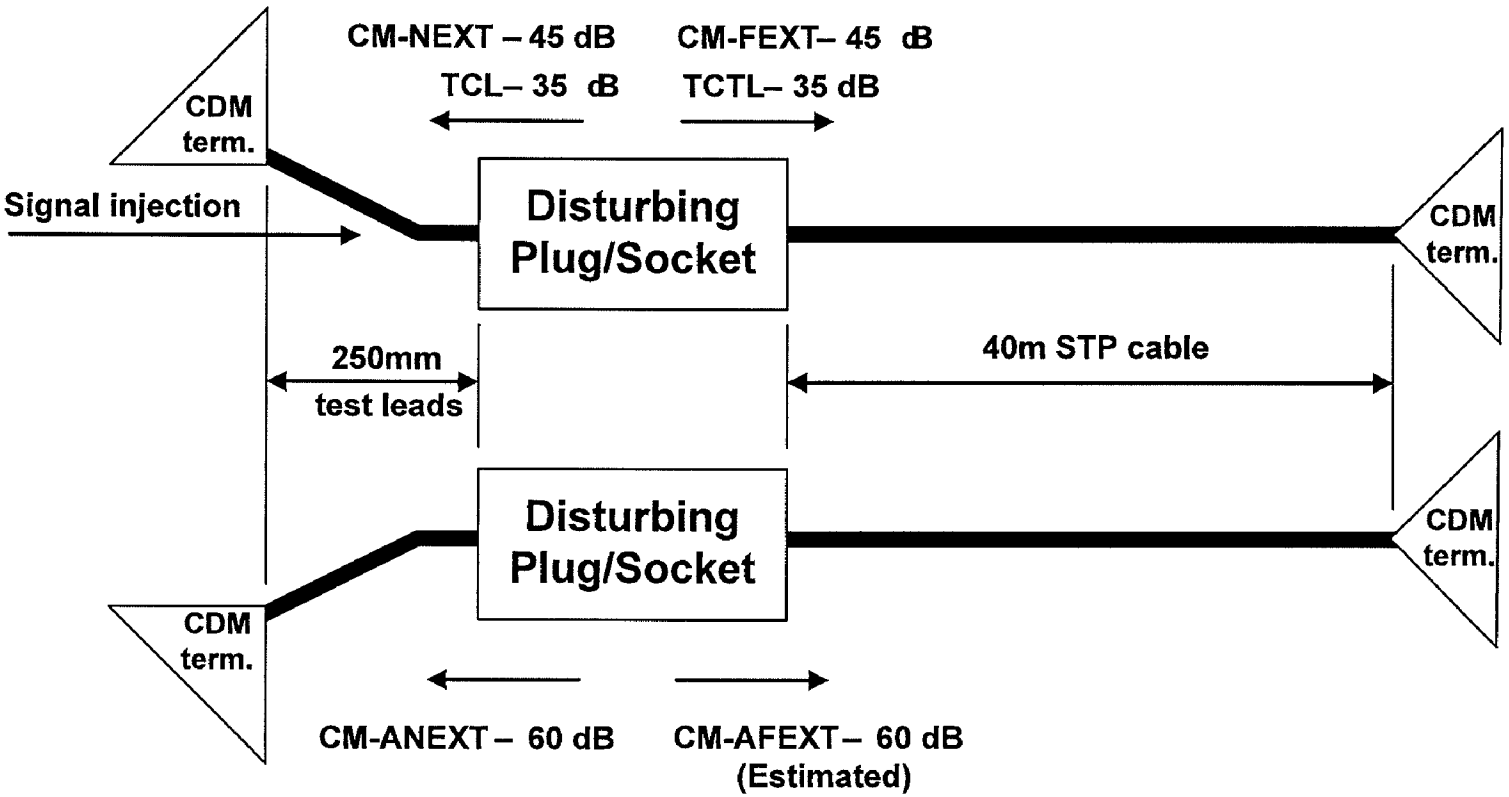
FIG. 5 is a schematic diagram of a test environment in which aspects of the present disclosure can be implemented and observed.

Referring to FIG. 5, a schematic of a data transmission network 500 is shown having a first transmission channel 502 and a second transmission channel 504 located in physical proximity to each other. The data transmission network 500 is shown as an exemplary crosstalk testing configuration to illustrate selected crosstalk effects between the two transmission channels shown, and to assess crosstalk effects between neighboring mated connectors and common mode conversion in a connector. In additional embodiments, the data transmission network could have additional transmission lines and/or channels consistent with the present disclosure.

The first transmission channel 502 has a first connector 506, which as shown can be a plug and jack such as are disclosed in FIGS. 1-4. The second transmission channel 504 has a second connector 508, which can also be a plug and socket as shown. Both the first and the second transmission channels 502, 504 have a length of twisted pair cable attached to the first and second connector 506, 508, respectively. A 40 meter twisted pair cable is shown to be attached between each of the first and second connectors 506, 508 and cable terminations 510. At each end of the first and second transmission channels 502, 504, cable terminations 510 minimize reflection of data signals on the transmission line, such as via a matched impedance configuration.

A signal is injected onto the first transmission channel 502 at a point to one side of the first connector 506. The signal travels through the first connector 506 and along the first twisted pair cable, reaching a cable termination 510. As the signal passes through the first connector 506, crosstalk is generated by the wires and other components within the plug and jack. This crosstalk can include both differential mode crosstalk and common mode crosstalk.

At the connector 506, the injected differential mode signal encounters capacitive and inductive coupling effects of a given magnitude and centered on the connector. NEXT and FEXT are generated on other twisted pairs within the jack. In the present embodiment, common mode crosstalk is shown to be −45 dB in both directions. On the same twisted pair, reflected TCL and transmitted TCTL represent the undesirable signal noise transmitted or reflected based on the effect of the inductive and capacitive elements. The TCL and TCTL are shown to be −35 dB in both directions.

At a neighboring plug/jack combination, alien NEXT/FEXT is generated due to close association between the disturbing first connector 506 and the disturbed second connector 508. This alien crosstalk can propagate from the second connector 508 down the twisted pairs associated with that connector, and can include common mode alien crosstalk. In the example shown, the observed initial common mode ANEXT is shown to be −60 dB, and common mode AFEXT is estimated to be −60 dB as well.

Figure 6:
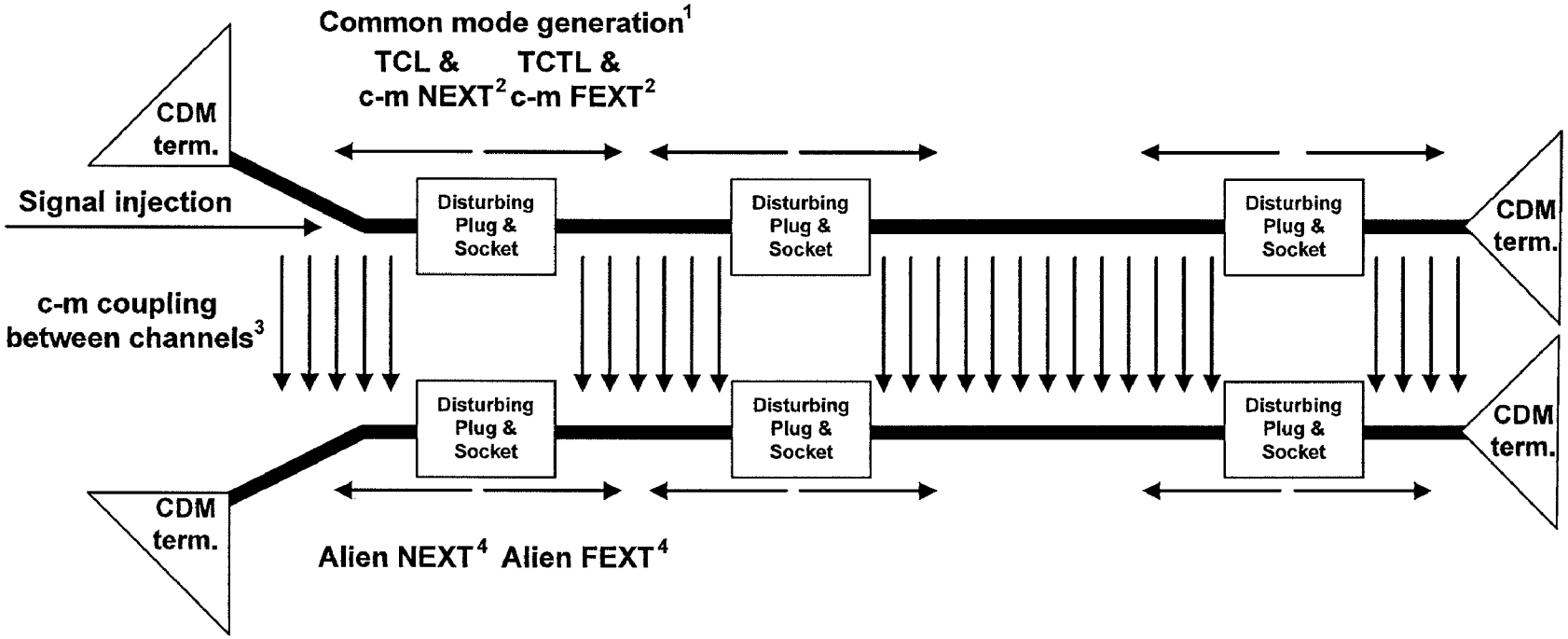
FIG. 6 is a schematic diagram of a multiple connection communications network in which aspects of the present disclosure can be implemented.

Referring to FIG. 6, a schematic diagram of a multiple connection communications channel 600 is shown in which aspects of the present invention can be implemented. The system as shown illustrates the common mode effects of a single cable of one or more pairs on other twisted pairs within the same cable as well as within a near neighbor cable. As in FIG. 5, common mode conversion occurs within a first channel 602, which can include four twisted pairs as shown in FIG. 1. This generates TCL and TCTL on the transmitting pair, common mode NEXT and FEXT in disturbed pairs within the same channel 602, and ANEXT/AFEXT within a neighboring "disturbed" channel 604. As the inserted differential signal travels along the network, each plug/socket combination generates common mode TCL and TCTL signals which in turn affect the neighboring pairs within the same and neighboring channels 602, 604 as described in FIG. 5. Excluding common mode effects in existence on the channel, as differential mode signals enter a plug/jack, ANEXT and AFEXT are generated at the neighboring plug/jack; within a cable the ANEXT and AFEXT are generated in neighboring cables. In addition, because of the common mode problem, both differential mode and common mode signals exist on the cable. The common mode signals couple to and from other neighboring cables easily.

Although crosstalk attenuates with distance from the source of the crosstalk, a large number of plug/socket connector combinations has an additive effect upon the total crosstalk in the channel. The additive crosstalk effects within bundles of cables are due in part to alien crosstalk effects. The alien crosstalk effects are much larger than may be anticipated due to the additive effects of common mode conversions along cabling having a number of transmission lines in close physical proximity.

As shown in FIGS. 5-6, crosstalk can have a negative effect upon the performance of wired pairs located within the same channel as well as within neighboring channels. Hence, compensation schemes are necessary to prevent signal loss and conversion at each connector location. Compensation schemes should account for NEXT and FEXT, but should also account for possible alien crosstalk as well as common mode effects, which can also have a detrimental effect on transmission lines. As higher frequency data transmission becomes required, it is optimal to provide cabling with compensation arrangements which are backwards compatible with slower speed systems. For example, Category 6 cabling operating at 250 MHz should also be useable as a category 5 system running at 100 MHz, and even slower category 3 speeds. Using just capacitive elements not in balance across the line, adverse effects on return loss, insertion loss, and balance can be introduced because more capacitive compensation must be added than in systems using capacitive and inductive coupling elements for crosstalk compensation. FIGS. 7-8 illustrate solutions to these limitations, using the structures disclosed in FIGS. 1-4, consistent with principles of the present disclosure.

Referring now to FIGS. 7-8, schematic illustrations of crosstalk compensation schemes are shown consistent with the present disclosure. In designing the compensation schemes shown in FIGS. 7-8, a number of factors are taken into consideration when determining the placement of the compensation zones. One factor includes the need to accommodate signal travel in both directions (i.e., in forward and reverse directions) through the wire conduits within the connector, such as on a circuit board 144 shown in FIG. 4. To accommodate uniform forward and reverse transmissions, the compensation scheme preferably has a configuration with forward and reverse symmetry, as well as symmetric compensation on neighboring plugs/jacks to minimize alien crosstalk generation.

It is also desirable for the compensation scheme to provide optimized compensation over a relatively wide range of transmission frequencies. For example, in one embodiment, performance is optimized for frequencies ranging from 1 MHz to 500 MHz. It is further desirable for the compensation arrangement to take into consideration the phase shifts that occur as a result of the time delays that take place as signals travel between the zones of compensation. Such phase shifts depend upon the operating frequency of the communication network in which the compensation scheme is employed. In one embodiment phase shifts are optimized for use in a category 6 system running at frequencies over 250 MHz. The methods by which each configuration accomplishes both symmetry and phase shift are described in conjunction with FIGS. 7-8.

Figure 7A:
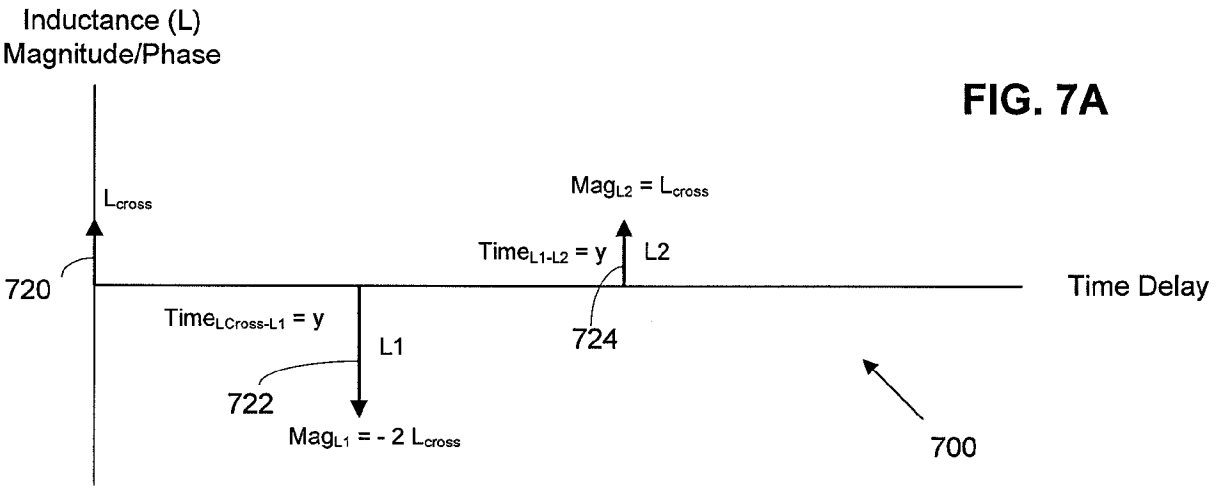
FIG. 7A is a schematic vector diagram showing an inductive compensation arrangement used to provide crosstalk compensation in a telecommunications jack.
Figure 7B:
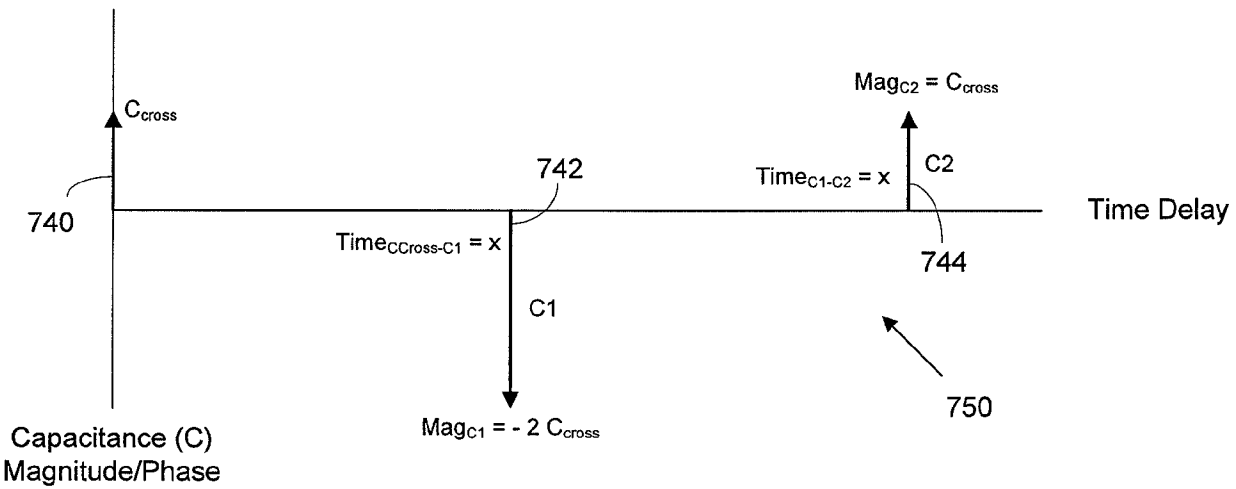
FIG. 7B is a schematic vector diagram showing a capacitive compensation arrangement used to provide crosstalk compensation in a telecommunications jack.

Referring to FIGS. 7A-7B, schematic vector diagrams 700, 750 illustrate inductive and capacitive compensation arrangements used in conjunction to provide crosstalk compensation in a telecommunications plug and jack according to a possible embodiment of the present disclosure. In the embodiment shown, two-stage capacitance and inductance configurations are applied across one or more wired pairs, such as the 3-6 pair or 4-5 pair of a plug-jack arrangement as shown above in FIG. 1. Of course, the crosstalk compensation arrangement disclosed could be used in conjunction with other wired pairs exhibiting substantial crosstalk as well.

The vectors of FIGS. 7A and 7B are configured such that the compensating inductance and capacitance elements are balanced, meaning that the targeted vector sum and difference resulting from application of inductance and capacitance to the selected pair is approximately zero for both inductance and capacitance.

The compensation arrangements in both FIGS. 7A and 7B include three vectors. The axis vectors 720, 740, shown as $L_{cross}$ and $C_{cross}$, respectively, represent the inductive and capacitive crosstalk emitted at a plug and jack between any two wired pairs. The axis vectors 720, 740 represent the cumulative sum of all crosstalk generated by the wired pair. In determining the crosstalk, both intra-channel and inter-channel effects are considered, in that the compensation arrangements contemplated by the present disclosure account for both cross-modal (common mode to differential mode) and alien crosstalk.

Referring to FIG. 7A, although not drawn to scale for purposes of illustration, it is contemplated that the inductive crosstalk 720 generally represents about a third of the total crosstalk effect generated at a plug/jack. This inductive crosstalk vector 720 is offset by first and second inductive compensation elements, L1 and L2. The second inductive vector 722 represents the inductive compensation provided by inductor L1, and the third inductive vector 724 represents inductive compensation provided by inductor L2.

Typical usage of capacitive compensation to adjust the inductive crosstalk effects results in usage of a higher compensating capacitance and makes balancing of the inductive crosstalk component impossible. This provides unbalanced capacitive configurations, which may have detrimental effects on the performance of the plug at certain operating frequencies and in certain directions. This is because NEXT is a vector difference of crosstalk components, whereas FEXT is a vector sum of the same components. Conversely, the arrangement of inductive elements shown in FIG. 7A counterbalances the inductive crosstalk $L_{cross}$ shown, as the vector sum and difference are both zero. Vector 722 has a magnitude of approximately twice that of vector 720, but of opposite phase. Vector 724 has a magnitude approximately equal to that of vector 720, and of the same phase.

Likewise, the capacitive compensation arrangement shown in FIG. 7B uses two zones of compensation, and is shown as three vectors. The capacitive crosstalk 740 is compensated by a first capacitive element C1 represented by vector 742, and a second capacitive element represented by vector 744. In the two zone capacitive configuration, the capacitive crosstalk is compensated based on vector 742 having a magnitude approximately twice that of vector 740, and of opposite phase. Vector 744 has approximately the same magnitude and phase as vector 740. Hence, the additive and differential vector relationships are approximately balanced with respect to capacitance as well.

With respect to both the inductive and capacitive crosstalk arrangements of FIGS. 7A-7B, it is preferred that phase shift and symmetry be carefully attended to. With respect to phase shift, it is desired to minimize the effect of phase shift in the compensation arrangement. Therefore it is preferred for vector 722 (inductive element L1) to be positioned as close as possible to the inductive crosstalk vector 720. The time delay shown in this configuration between the vectors is depicted as y. To maintain the forward and reverse symmetry preferred, vector 724 (inductive element L2) is optimally placed at a similar distance y from the second vector 722. Likewise, capacitive elements C1, C2 should be approximately equally spaced (such as at distance x as depicted) to maintain symmetry. Distances x and y can be the same or different distances, but both are relatively short so as to place the inductive and capacitive elements as close as possible to the contact springs.

The implementation of the schematic vector diagrams of FIGS. 7A-7B can be accomplished via a variety of methods. A preferred method involves determining the inductive and capacitive crosstalk generated by the connector when no compensating elements are applied. At least one inductive element can be applied to the uncompensated connector, and compensates for the inductive crosstalk measured. Preferably, at least a two stage inductive crosstalk compensation is applied, as shown in FIG. 7A. At least one capacitive element can then be applied, which compensates for the capacitive crosstalk. Preferably, a two stage capacitive crosstalk compensation is then applied. The capacitive and inductive crosstalk compensations are applied in such a way that they provide balanced crosstalk compensation for the capacitive and inductive crosstalk effects generated by the wired pair at the connector.

Additionally, the capacitive and inductive crosstalk compensation schemes of FIGS. 7A-7B can be applied in an equivalently balanced manner across multiple wire pairs within a channel, or multiple channels. This can be accomplished, for example, by applying compensation elements of approximately equal magnitude and in approximately the same positions on the multiple wire pairs in which compensation is applied. By maintaining balance in the multiple wire pairs in a channel or adjacent channels, alien crosstalk effects, which are substantial at higher frequencies, can be minimized.

In a possible implementation of the method, the capacitive portion of crosstalk is determined after application of one or more stages of inductive crosstalk compensation. This may be because application of inductive crosstalk compensation may affect the capacitive crosstalk generated by the connector, which in turn would affect the amount of capacitive crosstalk compensation which would need to be applied. This is particularly the case where inductive crosstalk compensation is accomplished via a crossover of wires. Such a crossover results in both inductive and capacitive effects, so application of such an inductive effect would necessarily change the capacitive component of crosstalk observed. This affects the magnitude of capacitive elements to be applied consistent with the principles described herein.

Additional zones or stages of compensation can be applied until the desired compensation level has been reached, which is determined by the crosstalk noise threshold tolerable at a given frequency. The crosstalk threshold may include a variety of differential mode and common mode effects, particularly as the frequency of the transmission line increases. Specifically, common mode crosstalk and alien crosstalk may require additional consideration to determine whether threshold levels of crosstalk emission are acceptable. It is anticipated by the present disclosure that the TCL and TCTL common mode effects require a level of compensation such that common mode generation levels are greater than 80-20 log (frequency) are required, although current standards only require levels greater than 68-20 log (frequency). The present disclosure anticipates similar threshold levels for cross-modal NEXT and cross-modal FEXT, resulting from the TCL and TCTL signals, which remain unspecified in current standards, such as for Category 5e or 6 cabling specifications.

Figure 8A:
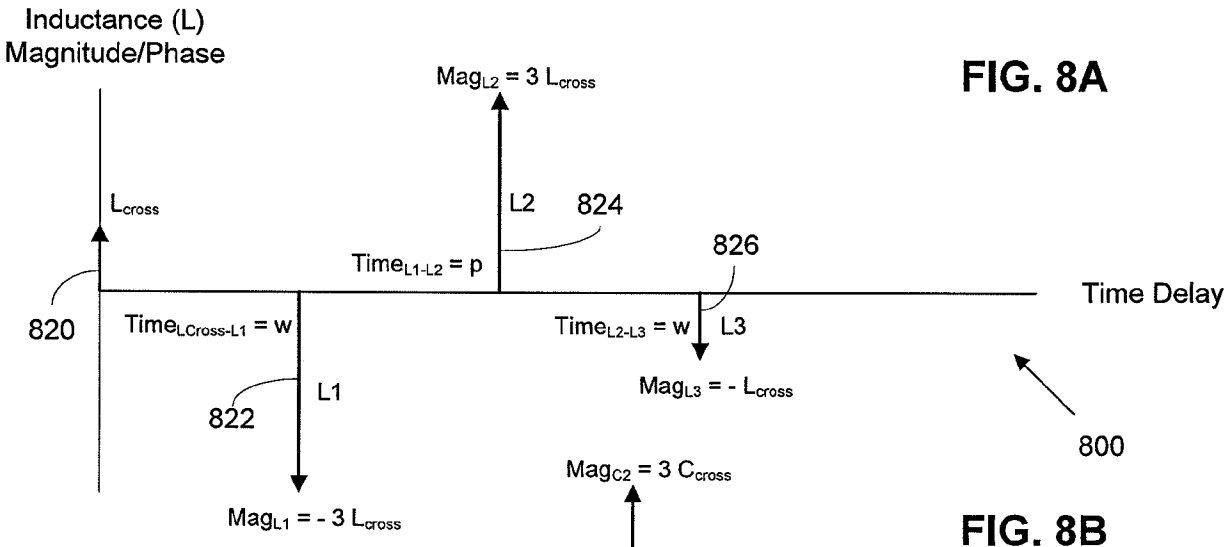
FIG. 8A is a schematic vector diagram showing a second inductive compensation arrangement used to provide crosstalk compensation in a telecommunications jack.
Figure 8B:
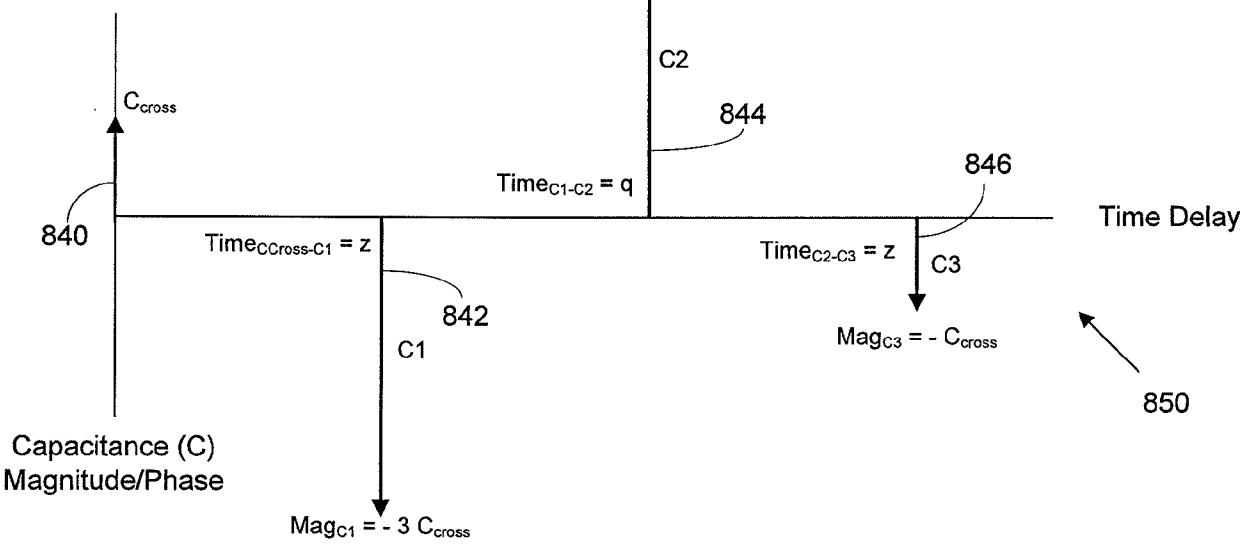
FIG. 8B is a schematic vector diagram showing a second capacitive compensation arrangement used to provide crosstalk compensation in a telecommunications jack.

Referring to FIGS. 8A-8B, a particular implementation of a connector implementing crosstalk compensation is shown. In the embodiment shown, the connector includes balanced inductive and capacitive elements that are used to in an iterative, multistage crosstalk compensation configuration.

The crosstalk compensation configuration shown has three zones of crosstalk compensation for both inductive and capacitive components of crosstalk. FIG. 8A reflects a three zone inductive compensation arrangement 800 designed to maintain symmetry, or "balance", between forward and reverse transmission quality of data signals. Vector 820 represents the inductive component of crosstalk generated by the plug and jack, and can include a number of forms of crosstalk, including alien crosstalk. Vectors 822, 824, and 826 represent inductive compensating zones, incorporating inductors L1-L3 at those stages, respectively. Vector 822 has a magnitude approximately three times the magnitude of $L_{cross}$, and of opposite phase. Vector 824 has a magnitude approximately three times the magnitude of $L_{cross}$, and of the same phase. Vector 826 has a magnitude approximately three times the magnitude of $L_{cross}$, and of the opposite phase. Hence, the sum of all inductive compensation zones and crosstalk is approximately zero.

Regarding time delay, a three zone compensation arrangement allows for adjustability/tuning of the compensation for a specific operating frequency range. Vector 822, representing L1 as the first inductive crosstalk compensation stage, is located at a time w from vector 820, the inductive crosstalk located at the connection between the plug and jack. Likewise, vector 826, representing L3 as the third inductive crosstalk compensation stage, is located at approximately the same time w from vector 824, representing L2 as the second inductive crosstalk compensation stage. The time between vectors 822 and 824 is shown to be a separate time p, largely unrelated to time w. Time p can be varied to achieve a desired level of compensation within a specified frequency range.

Similarly, FIG. 8B reflects a three zone capacitive compensation arrangement 850 designed to maintain symmetry between forward and reverse transmission quality of data signals. Vector 840 represents the capacitive component of crosstalk generated by the plug and front of the jack, and can also account for potential alien crosstalk. Vectors 842, 844, and 846 represent capacitive compensating zones, incorporating capacitors C1-C3 at those stages, respectively. Analogously to the inductive compensation vectors, vector 842 has a magnitude approximately three times the magnitude of $C_{cross}$, and of opposite phase. Vector 844 has a magnitude approximately three times the magnitude of $C_{cross}$, and of the same phase. Vector 846 has a magnitude approximately three times the magnitude of $C_{cross}$, and of the opposite phase. Hence, the sum of all capacitive compensation zones and crosstalk is approximately zero.

Regarding time delay, the time between $C_{cross}$ and C1 (and therefore vectors 840 and 842) is preferably the same as between C2 and C3 (vectors 844 and 846), shown as time z. The time between C1 and C2 (vectors 842 and 844) is shown as time q, which is largely unrelated with time z and can be varied to achieve a desired level of capacitive compensation within a given frequency range.

The time delays p and q between the second vectors 822, 824 and the third vectors 842, 844 of the capacitive and inductive arrangements are preferably selected to optimize the overall compensation effect of the compensation scheme over a relatively wide range of frequencies. By varying the time delays p and q between the vectors, the phase angles of the first and second compensation zones are varied thereby altering the amount of compensation provided at different frequencies. In one example embodiment, to design the time delays, the time delay p is initially set with a value generally equal to z (i.e., the time delay between the first vector 820 and the second vector 822). The system is then tested or simulated to determine if an acceptable level of compensation is provided across the entire signal frequency range intended to be used. If the system meets the crosstalk requirements with the value p set equal to z, then no further adjustment is needed. If the compensation scheme fails the crosstalk requirements at higher frequencies, the time delay p can be shortened to improve performance at higher frequencies. If the compensation scheme fails the crosstalk requirements at lower frequencies, the time delay p can be increased to improve crosstalk performance for lower frequencies. Likewise, the time delay q can be adjusted independently of p, and testing of the performance of q can start by using the time delay w between vectors 740 and 742. It will be appreciated that the time delays p and q can be varied without altering forward and reverse symmetry.

As discussed in conjunction with FIG. 7A-7B, it is preferred that phase shift and symmetry be carefully attended to. The positioning of the capacitive and inductive elements described above provides for tuning of crosstalk compensation to cover a desired frequency range within a pair. Further, the adjustable times p and q shown in FIGS. 8A and 8B can be adjusted in tandem or independently so as to optimize compensation of the inductive or capacitive portions of the crosstalk generated by the plug/jack combination. This independent or conjunctive tuning of inductive and capacitive effects within a pair can be used in conjunction with the principles of the present disclosure to manipulate the return loss levels over various frequency ranges.

The specific amount of capacitance and inductance involved in each compensation stage, the number of stages or zones of compensation, as well as the time spacing of the compensation elements depends upon the desired compensation to be achieved. Compensation for a narrow range of frequencies can be accomplished with fewer compensation stages. Compensation for a wide range of frequencies may require additional compensation stages. Further, compensation to a lower crosstalk noise level, such as when accounting for alien crosstalk and/or cross-modal crosstalk, may require additional stages of crosstalk compensation. However, the number of zones/stages of crosstalk compensation is not dictated by the present disclosure, and can be tailored to a particular application requiring specific stages and inductance/capacitance values.

Similarly to FIGS. 7A-7B, the vector compensation arrangement of FIGS. 8A-8B can be implemented by a variety of methods. It is possible to apply the method described above in conjunction with FIGS. 7A-7B to the crosstalk compensation configuration of FIGS. 8A-8B, simply by applying the three inductive stages, followed by applying the three capacitive stages. As in the previously described method, it may be desirable to determine the capacitive component of crosstalk after applying the inductive crosstalk compensation. Furthermore, the embodiment of FIGS. 8A-8B can be applied to multiple wire pairs within a plug and jack of a connector, as previously described in conjunction with FIGS. 7A-7B to ensure balance across pairs in order to further address the detrimental effects of alien crosstalk. Additional compensation components can be added to reach a desired tolerance on an iterative basis.

The vector schematics of FIGS. 7-8 represent only two theoretical combinations of balanced inductive and capacitive arrangements. Additional balanced arrangements using inductive and capacitive elements can be designed consistent with the present disclosure, some examples of which can include additional compensation zones consistent with the principles of vector cancellation illustrated above.

The above specification, examples and data provide a complete description of the manufacture and use of the composition of the invention. Since many embodiments of the invention can be made without departing from the spirit and scope of the invention, the invention resides in the claims hereinafter appended.

The claimed invention is:

1. A method of compensating for crosstalk occurring within a telecommunications jack, the method comprising:

applying a plurality of inductive elements across a plurality of wire pairs, the plurality of inductive elements forming first and second zones of inductive crosstalk compensation, the first and second zones of inductive crosstalk compensation cooperating with inductive crosstalk generated at contact springs of the jack to provide forward and reverse symmetry; and applying a plurality of capacitive elements across the plurality of wire pairs, the plurality of inductive elements forming first and second zones of capacitive crosstalk compensation, the first and second zones of capacitive crosstalk compensation cooperating with capacitive crosstalk generated at contact springs of the jack to provide forward and reverse symmetry.

2. The method of claim 1, wherein the plurality of inductive elements provides a balanced compensation arrangement across the plurality of wire pairs.

3. The method of claim 1, wherein the plurality of wire pairs includes a 3-6 wire pair and a 4-5 wire pair within a telecommunications jack.

4. The method of claim 1, further comprising determining an uncompensated crosstalk at the plurality of wire pairs, the uncompensated crosstalk including an uncompensated inductive crosstalk component and an uncompensated capacitive crosstalk component.

5. The method of claim 4, wherein determining an uncompensated crosstalk at the plurality of wire pairs includes determining an uncompensated differential mode crosstalk and an uncompensated common mode crosstalk.

6. The method of claim 1, wherein the first zone of inductive crosstalk is disposed at a first distance from the contact springs of the jack, and wherein the first distance is approximately equal to a distance between the first zone of inductive crosstalk and the second zone of inductive crosstalk.

7. The method of claim 6, wherein the first zone of capacitive crosstalk is disposed at a second distance from the contact springs of the jack, and wherein the second distance is approximately equal to a distance between the first zone of capacitive crosstalk and the second zone of capacitive crosstalk.

8. The method of claim 7, wherein the first distance and the second distance are unequal.

9. The method of claim 1, wherein the plurality of inductive elements further forms a third zone of inductive crosstalk compensation cooperating with the first and second zones of inductive crosstalk compensation and inductive crosstalk generated at contact springs of the jack to provide forward and reverse symmetry.

10. The method of claim 1, wherein the plurality of capacitive elements further forms a third zone of capacitive crosstalk compensation cooperating with the first and second zones of capacitive crosstalk compensation and capacitive crosstalk generated at contact springs of the jack to provide forward and reverse symmetry.

11. The method of claim 1, wherein a total magnitude of inductive crosstalk at the first zone of inductive crosstalk compensation is at least about twice the inductive crosstalk generated at the jack.

12. The method of claim 11, wherein a total magnitude of capacitive crosstalk at the first zone of capacitive crosstalk compensation is at least about twice the capacitive crosstalk generated at the jack.

13. A telecommunications jack comprising:

a plurality of contact springs associated with a plurality of wire pairs;

a plurality of inductive elements disposed across the plurality of wire pairs, the plurality of inductive elements forming first and second zones of inductive crosstalk compensation, the first and second zones of inductive crosstalk compensation cooperating with inductive crosstalk generated at the contact springs to provide forward and reverse symmetry; and a plurality of capacitive elements disposed across the plurality of wire pairs, the plurality of inductive elements forming first and second zones of capacitive crosstalk compensation, the first and second zones of capacitive crosstalk compensation cooperating with capacitive crosstalk generated at the contact springs to provide forward and reverse symmetry.

14. The telecommunications jack of claim 13, wherein the plurality of inductive elements include wire crossover locations.

15. The telecommunications jack of claim 13, wherein a total magnitude of inductive crosstalk at the first zone of inductive crosstalk compensation is at least about twice the inductive crosstalk generated at the jack.

16. The telecommunications jack of claim 15, wherein a total magnitude of capacitive crosstalk at the first zone of capacitive crosstalk compensation is at least about twice the capacitive crosstalk generated at the jack.

17. The telecommunications jack of claim 13, wherein the plurality of wire pairs includes a 3-6 wire pair and a 4-5 wire pair within a telecommunications jack.

18. The telecommunications jack of claim 13, wherein the first zone of inductive crosstalk is disposed at a first distance from the contact springs of the jack, and wherein the first distance is approximately equal to a distance between the first zone of inductive crosstalk and the second zone of inductive crosstalk.

19. The telecommunications jack of claim 18, wherein the first zone of capacitive crosstalk is disposed at a second distance from the contact springs of the jack, and wherein the second distance is approximately equal to a distance between the first zone of capacitive crosstalk and the second zone of capacitive crosstalk.

20. The telecommunications jack of claim 19, wherein the first distance and the second distance are unequal.

21. A telecommunications jack comprising:

a plurality of contact springs associated with a plurality of wire pairs;

a plurality of inductive elements disposed across the plurality of wire pairs, the plurality of inductive elements forming first and second zones of inductive crosstalk compensation, the first and second zones of inductive crosstalk compensation cooperating with inductive crosstalk generated at the contact springs to provide forward and reverse symmetry, wherein a total magnitude of inductive crosstalk at the first zone of inductive crosstalk compensation is at least about twice the inductive crosstalk generated at the jack, and wherein the plurality of inductive elements provides a balanced inductive compensation arrangement across the plurality of wire pairs; and a plurality of capacitive elements disposed across the plurality of wire pairs, the plurality of inductive elements forming first and second zones of capacitive crosstalk compensation, the first and second zones of capacitive crosstalk compensation cooperating with capacitive crosstalk generated at the contact springs to provide forward and reverse symmetry, wherein a total magnitude of capacitive crosstalk at the first zone of capacitive crosstalk compensation is at least about twice the capacitive crosstalk generated at the jack, and wherein the plurality of capacitive elements provides a balanced capacitive compensation arrangement across the plurality of wire pairs.

* * * * *